US005465902A

United States Patent [19]

Hanson

[11] Patent Number: 5,465,902

[45] Date of Patent: Nov. 14, 1995

[54] MULTI-FUNCTIONAL MAILBOX

[76] Inventor: Terry E. Hanson, 5045 Hanson Rd., Hermantown, Minn. 55810

[21] Appl. No.: 239,909

[22] Filed: May 9, 1994

[51] Int. Cl.[6] ..... B65D 91/00

[52] U.S. Cl. ..... 232/33; 232/1 C; 232/39; 232/24

[58] Field of Search ..... 232/1 C, 17, 24, 232/25, 29, 33, 38, 39, 19, 22, 27, 45

[56] References Cited

U.S. PATENT DOCUMENTS

| | | | |
|---|---|---|---|
| 410,905 | 9/1889 | Lewis | 232/29 |
| 472,105 | 4/1892 | Bussard | 232/24 |
| 613,275 | 11/1898 | Hintze | 232/19 |
| 877,742 | 1/1908 | Schiffer | 232/35 |
| 1,026,338 | 5/1912 | Bailey | 232/35 |
| 1,508,801 | 9/1924 | Miller | 232/24 |
| 3,243,104 | 3/1966 | Fillion | 232/29 |
| 4,146,171 | 3/1979 | Hodge | 232/1 C |

*Primary Examiner*—Flemming Saether

[57] ABSTRACT

A multi-functional mailbox having a mail housing. The mail housing has a recessed flat bottom and an arched top. A mail housing lid is hingedly secured to the open first end of the mail housing. The device has a newspaper housing dimensioned to be received within a recessed bottom of the mail housing. A newspaper housing lid is hingedly secured to the newspaper housing. A sliding indicator means is secured within the newspaper housing lid. The sliding indicator means has a first position indicating the presence of mail and a second position indicating the absence of mail.

7 Claims, 4 Drawing Sheets

MULTI-FUNCTIONAL MAILBOX

BACKGROUND OF THE INVENTION

1. Field of the Invention

The present invention relates to mail box improvement and more particularly pertains to providing a separate compartment for newspapers.

2. Description of the Prior Art

The use of mailboxes is known in the prior art. More specifically, mailboxes heretofore devised and utilized for the purpose of holding mail not delivered by the post office are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,146,171 to Hodge a newspaper delivery box. U.S. Pat. No. 5,000,380 to Barrios discloses a letter retaining and protecting device.

U.S. Pat. No. 3,516,600 to Andis discloses a deposit receptacle for newspapers or the like.

U.S. Pat. No. 4,896,827 to Economou discloses a mailbox system. The mailbox utilizes a sliding mail tray which slides out of the mailbox as the mailbox door is opened and is returned to the interior of the mailbox when the mailbox is closed.

U.S. Pat. No. 4,002,291 to Hodge discloses a newspaper delivery tube insert.

In this respect, the mail box improvement according to the present invention substantially departs from the conventional concepts and designs of the prior art, and in doing so provides an apparatus primarily developed for the purpose of providing a separate compartment for newspapers.

Therefore, it can be appreciated that there exists a continuing need for new and improved mail box improvement which can be used for providing a separate compartment for newspapers. In this regard, the present invention substantially fulfills this need.

SUMMARY OF THE INVENTION

In view of the foregoing disadvantages inherent in the known types of mailboxes now present in the prior art, the present invention provides an improved mail box improvement. As such, the general purpose of the present invention, which will be described subsequently in greater detail, is to provide a new and improved mail box improvement and method which has all the advantages of the prior art and none of the disadvantages.

To attain this, the present invention essentially comprises a mailbox improvement having a mail housing with an open first end, a closed second end, an intermediate extent therebetween. The mail housing has a recessed flat bottom and an arced top. The device has a right sidewall that extends below the recessed flat bottom intermediate the open first end and the closed second end. A plurality of apertures are formed along the right sidewall. The device has a left sidewall that extends below the recessed flat bottom intermediate the open first end and the closed second end. A plurality of apertures are formed along the left sidewall. A mail housing lid is hingedly secured to the open first end of the mail housing.

The device has a newspaper housing having an open first end, a closed second end, and an intermediate extent therebetween. The newspaper housing has a flat top and a flat bottom. The newspaper housing has a U-shaped piece having a first extension, a second extension, and a planar portion. The planar portion is secured to the flat top of the newspaper housing. The U-shaped piece is dimensioned to be received within the recessed bottom of the mail housing. Fastening means secures the first extension of the U-shaped piece to the right sidewall of the mail housing and the second extension of the U-shaped piece to the left sidewall of the mail housing. A newspaper housing lid is hingedly secured to the open first end of the newspaper housing. A sliding indicator means is secured within the newspaper housing lid. The sliding indicator means has a first position indicating the presence of mail and a second position indicating the absence of mail. More specifically the sliding indicating means is comprised of a window that is formed within the newspaper housing lid. The sliding indicating means has a red square flag with a flat surface. The red square flag has a top edge, a bottom edge, a left side, and a right side. The right side has a curved edge. The red square flag has a first position displayed in the window indicating the presence of mail and a second position displayed in the window indicating the absence of mail. A spring is secured to the curved edge of the red square flag. The spring has a top section, a bottom section, and an intermediate extent therebetween. An aperture is formed through the intermediate extent of the spring. The spring functions to urge the red square flag to the first position indicating the presence of mail. A horizontal slot is formed through the newspaper housing lid. The horizontal slot has a first end and a second end. The first end has a downward extension. A knob is dimensioned to be received within the horizontal slot. When the knob is positioned in the second end of the horizontal slot it corresponds to the red square flag in the first position. When the knob is in the first end of the horizontal slot it corresponds to the red square flag in the second position. The device has a pulley system that includes a cable. The cable has a first end, a second end, and an intermediate extent therebetween. The first end is secured to the knob. The second end is secured to the flat surface of the red square flag. The intermediate extent is received through the aperture that is formed within the intermediate extent of the spring. The pulley system retracts the red square flag away from the window to the second position indicating the absence of mail.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mail box improvement which have all the advantages of the prior art mailboxes and none of the disadvantages.

It is another object of the present invention to provide a new and improved mail box improvement which may be easily and efficiently manufactured and marketed.

It is further object of the present invention to provide a new and improved mail box improvement which are of durable and reliable constructions.

An even further object of the present invention is to provide a new and improved mail box improvement which are susceptible of a low cost of manufacture with regard to both materials and labor, and which accordingly are then susceptible of low prices of sale to the consuming public, thereby making such mail box improvement economically available to the buying public.

Still yet another object of the present invention is to provide a new and improved mail box improvement which provide in the apparatuses and methods of the prior art some of the advantages thereof, while simultaneously overcoming some of the disadvantages normally associated therewith.

Even still another object of the present invention is to provide a separate compartment for newspapers.

Lastly, it is an object of the present invention to provide a new and improved mailbox improvement having a mail housing with an open first end, a closed second end, an intermediate extent therebetween. The mail housing has a recessed flat bottom and an arced top. The device has a right sidewall that extends below the recessed flat bottom intermediate the open first end and the closed second end. A plurality of apertures are formed along the right sidewall. The device has a left sidewall that extends below the recessed flat bottom intermediate the open first end and the closed second end. A plurality of apertures are formed along the left sidewall. A mail housing lid is hingedly secured to the open first end of the mail housing. The device has a newspaper housing having an open first end, a closed second end, and an intermediate extent therebetween. The newspaper housing has a flat top and a flat bottom. The newspaper housing has a U-shaped piece having a first extension, a second extension, and a planar portion. The planar portion is secured to the flat top of the newspaper housing. The U-shaped piece is dimensioned to be received within the recessed bottom of the mail housing. A fastening means secures the first extension of the U-shaped piece to the right sidewall of the mail housing and the second extension of the U-shaped piece to the left sidewall of the mail housing. A newspaper housing lid is hingedly secured to the open first end of the newspaper housing. A sliding indicator means is secured within the newspaper housing lid. The sliding indicator means has a first position indicating the presence of mail and a second position indicating the absence of mail.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
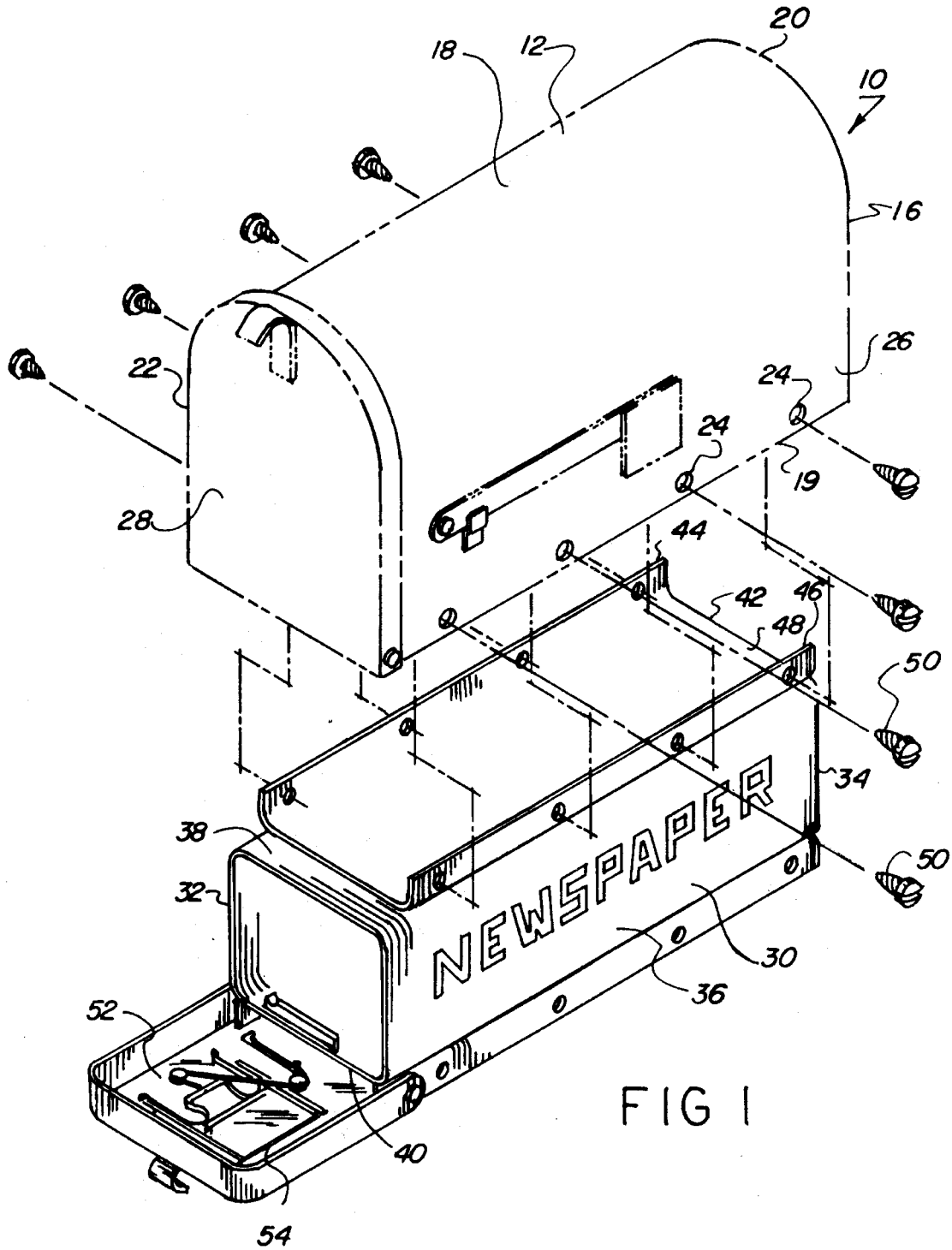
FIG. 1 is a perspective view of the preferred embodiment of the rural mail box improvement constructed in accordance with the principles of the present invention.
Figure 2:
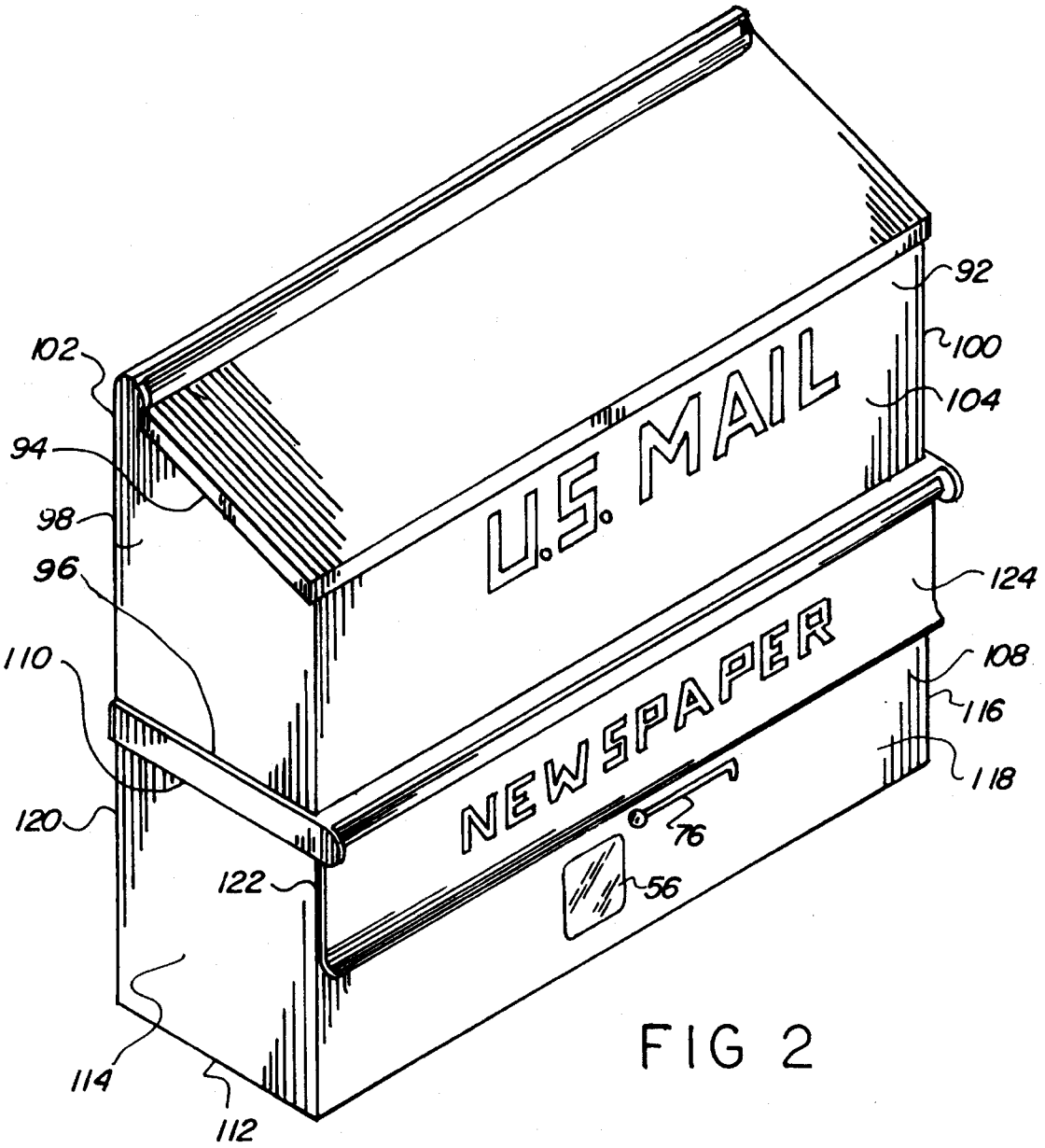
FIG. 2 is a perspective view of the preferred embodiment of the urban mail box improvement constructed in accordance with the principles of the present invention.
Figures 3, 4:
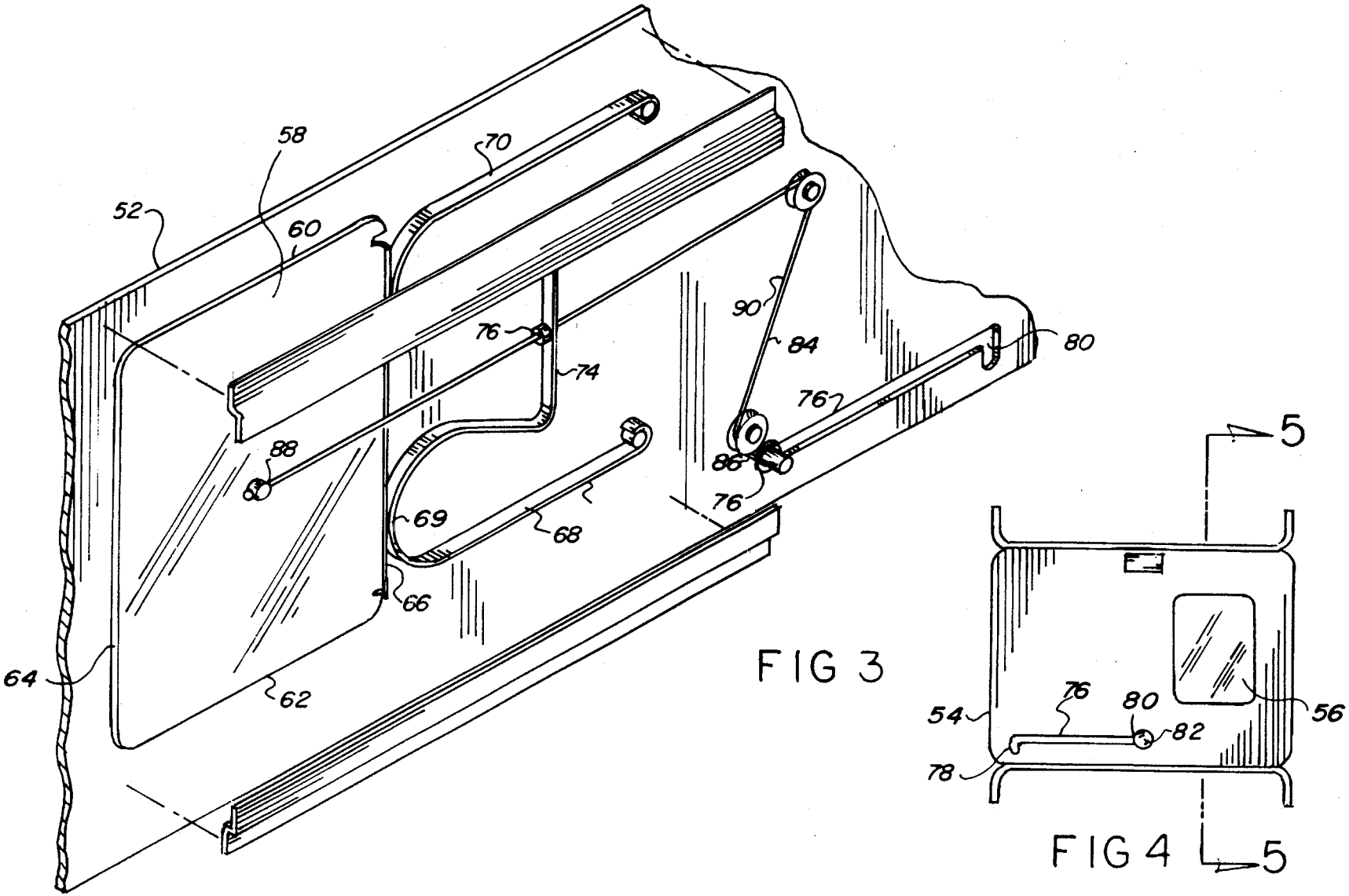
FIG. 3 is a perspective view of the sliding indicator means.
FIG. 4 is a front view of the newspaper housing lid of the present invention.
Figure 5:
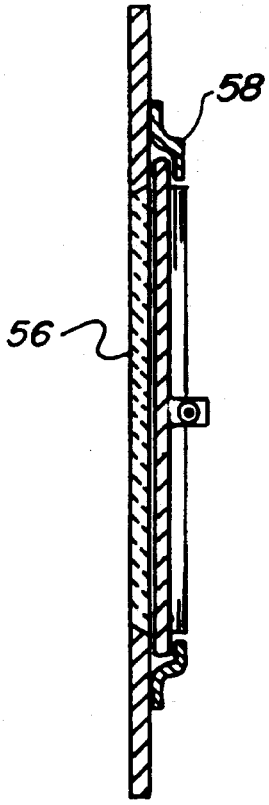
FIG. 5 is a sectional view of the present invention taken along line 5—5 of FIG. 4.
Figure 6:
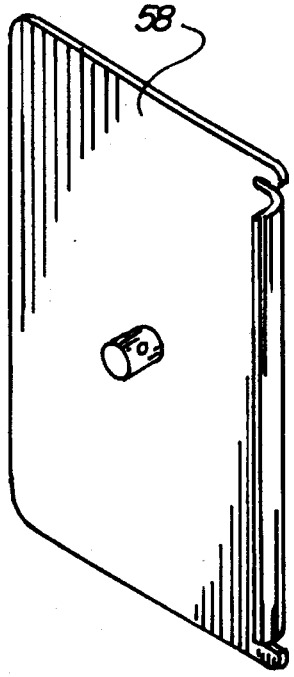
FIG. 6 is a perspective view of the red square flag of the sliding indicator means of the present invention.
Figure 7:
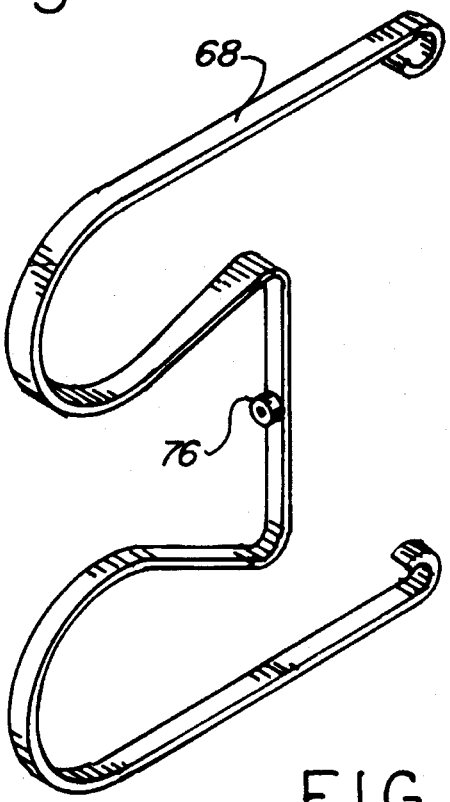
FIG. 7 is a perspective view of the spring element of the sliding indicator means of the present invention.

With reference now to the drawings, and in particular to FIG. 1 thereof, the preferred embodiment of the new and improved mail box improvement embodying the principles and concepts of the present invention and generally designated by the reference numeral 10 will be described.

More specifically, it will be noted in the various Figures that the present invention relates holding device for newspapers and other articles not delivered by the post office. The device can be connected to current mailboxes or it can built into new ones. The device eliminates the need for separate poles and tubes for newspapers. In its broadest context, the device includes a mail housing, a mail housing lid, a newspaper housing, a newspaper housing lid, and a sliding indicator means.

The first mailbox improvement is the rural option. The device 10 includes a mail housing 12 having an open first end 14, a closed second end 16, an intermediate extent therebetween 19. The mail housing 12 has a recessed flat bottom 18 and an arced top 20. The device 10 has a right sidewall 22 that extends below the recessed flat bottom 18 intermediate the open first end 14 and the closed second end 16. A plurality of apertures 24 are formed along the right sidewall 22. The device 10 has a left sidewall 26 that extends below the recessed flat bottom 18 intermediate the open first end 14 and the closed second end 16. A plurality of apertures 24 are formed along the left sidewall 26. A mail housing lid 28 is hingedly secured to the open first end 14 of the mail housing 12.

The device 10 has a newspaper housing 30 having an open first end 32, a closed second end 34, and an intermediate extent therebetween 36. The newspaper housing 30 has a flat top 38 and a flat bottom 40. The newspaper housing 30 has a U-shaped piece 42 having a first extension 44, a second extension 46, and a planar portion 48. The planar portion 48 is secured to the flat top 38 of the newspaper housing 30. The U-shaped piece 42 is dimensioned to be received within the recessed bottom 18 of the mail housing 12. Fastening means 50 secures the first extension 44 of the U-shaped piece 42 to the right sidewall 22 of the mail housing 12 and the second extension 46 of the U-shaped piece 42 to the left sidewall 26 of the mail housing 12. A newspaper housing lid 52 is hingedly secured to the open first end 32 of the newspaper housing 30.

A sliding indicator means 54 is secured within the newspaper housing lid 52. The sliding indicator means 54 has a first position indicating the presence of mail and a second position indicating the absence of mail. More specifically the sliding indicating means 54 is comprised of a window 56 that is formed within the newspaper housing lid 52. The sliding indicating means 54 has a red square flag 58 with a flat surface. The red square flag 58 has a top edge 60, a bottom edge 62, a left side 64, and a right side 66. The right side 66 has a curved edge. The red square flag 58 has a first position displayed in the window 56 indicating the presence of mail and a second position not displayed in the window indicating the absence of mail.

A spring 68 is secured to the curved edge 66 of the red square flag 58. The spring 68 has a top section 70, a bottom section 72, and an intermediate extent 74 therebetween. An aperture 76 is formed through the intermediate extent 74 of the spring 68. The spring 68 functions to urge the red square flag 58 to the first position indicating the presence of mail. A horizontal slot 76 is formed through the newspaper housing lid 52. The horizontal slot 76 has a first end 78 and a second end 80. The first end 78 has a downward extension. A knob 82 is dimensioned to be received within the horizontal slot 76. When the knob 82 is positioned in the second end 80 of the horizontal slot 76 it corresponds to the red square flag 58 in the first position. When the knob 82 is in the first end 78 of the horizontal slot 76 it corresponds to the red square flag 58 in the second position.

The device 10 has a pulley system that includes a cable 84. The cable 84 has a first end 86, a second end 88, and an intermediate extent 90 therebetween. The first end 86 is secured to the knob 82. The second end 88 is secured to the flat surface of the red square flag 58. The intermediate extent 90 is received through the aperture 76 that is formed within the intermediate extent 74 of the spring 68. The pulley system retracts the red square flag 58 away from the window 56 to the second position indicating the absence of mail.

The second mailbox improvement is the urban option. The device 10 includes an urban mail housing 92 having an open upper end 94, a closed lower end 96, a right side wall 98, a left side wall 100, a rear wall 102, and a front wall 104. The open upper end 94 is inclined downward from the rear wall 102 to the front wall 104. The urban mail housing 92 has a length and a width. An upper urban mail housing lid 106 is hingedly secured to the rear wall 102 of the open upper end 94 of the urban mail housing 92.

The device 10 includes an urban newspaper housing 108 having a top end 110, a closed bottom 112, a left side wall 114, a right side wall 116, a front wall 118, and a rear wall 120. The top end 110 is secured to the closed lower end 96 of the urban mail housing 92. An opening 122 is formed along the front wall 118. A lower urban newspaper housing lid 124 is hingedly secured to the top end 110 of the urban newspaper housing 108. The urban mail housing lid 124 serves to cover the opening 122 that is formed along the front wall 118 of the urban newspaper housing 108.

A sliding indicator means 54 is secured within the front wall 118 of the urban newspaper housing 108. The sliding indicator means 54 has a first position indicating the presence of mail and a second position indicating the absence of mail. More specifically the sliding indicator means 54 is comprised of a window 56 that is formed within the front wall 118 of the urban newspaper housing 108. The device 10 has a red square flag 58 with a flat surface. The red square flag 58 has a top edge 60, a bottom edge 62, a left side 64, and a right side 66. The right side 66 has a curved edge. The red square flag 58 has a first position that is displayed in the window 56 indicating the presence of mail and a second position that is not displayed in the window indicating the absence of mail.

A spring 68 is secured to the curved edge 66 of the red square flag 58. The spring 68 has a top section 70, a bottom section 72, and an intermediate extent 74 therebetween. An aperture 76 is formed through the intermediate extent 74 of the spring 68. The spring 68 urges the red square flag 58 to the first position indicating the presence of mail.

A horizontal slot 76 is formed through the front wall 118 of the urban newspaper housing 108. The horizontal slot 76 has a first end 78 and a second end 80. The first end 78 has a downward extension. A knob 82 is dimensioned to be received within the horizontal slot 76. When the knob 82 is positioned in the second end 80 of the horizontal slot 76 it corresponds to the red square flag 58 in the first position. When the knob 82 is in the first end 78 of the horizontal slot 76 it corresponds to the red square flag 58 in the second position.

The device 10 has a pulley system that includes a cable 84. The cable 84 has a first end 86, a second end 88, and an intermediate extent 90 therebetween. The first end 86 is secured to the knob 82. The second end 88 is secured to the flat surface of the red square flag 58. The intermediate extent 90 is received through the aperture 76 that is formed within the intermediate extent 74 of the spring 68. The pulley system 84 retracts the red square 58 flag away from the window 56 to the second position indicating the absence of mail.

The present invention provides a separate compartment attached to a regular mailbox for newspapers and other mail not delivered by the post office. Currently it is against the law to insert anything in a mailbox that is not delivered by postal personnel. Adding a separate compartment where these and other materials can be inserted may be a way to remain within the law. Furthermore, the separate poles and tubes for newspapers that populate our landscape would be unnecessary.

The present invention can be built into new mailboxes or added to existing ones. The extra compartment typically fits unobtrusively under the one used for regular mail. It can be attached to existing mailboxes with the use of a few screws. Like a regular mailbox it has an indicator to show when there is something inside it.

This product comes in a variety of versions compatible with both rural and city mailbox styles. In view of the fact that it is both more convenient for the user and less of an eyesore than separate poles and tubes, the present invention offers people an alternative to their current arrangement.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved mailbox improvement comprising in combination:

a mail housing having an open first end, a closed second end, an intermediate extent therebetween, the mail housing having a recessed flat bottom and an arced top, a right sidewall extending below the recessed flat bottom intermediate the open first end and the closed second end, a plurality of apertures formed along the right sidewall, a left sidewall extending below the recessed flat bottom intermediate the open first end and the closed second end, a plurality of apertures formed along the left sidewall;

a mail housing lid hingedly secured to the open first end of the mail housing;

a newspaper housing having an open first end, a closed second end, and an intermediate extent therebetween, the newspaper housing having a flat top and a flat bottom, a U-shaped piece having a first extension, a second extension, and a planar portion therebetween, the planar portion secured to the flat top of the newspaper housing, the U-shaped piece dimensioned to be received within the recessed bottom of the mail housing; fastening means securing the first extension of the U-shaped piece to the right sidewall of the mail housing and the second extension of the U-shaped piece to the left sidewall of the mail housing;

a newspaper housing lid hingedly secured to the open first end of the newspaper housing; and a sliding indicator means secured within the newspaper housing lid, the sliding indicator means having a first position indicating the presence of mail and a second position indicating the absence of mail.

2. The device as described in claim 1 and further comprising:

a window formed within the newspaper housing lid.

3. The device as described in claim 2 and further comprising:

a red square flag having a flat surface; the red square flag having a top edge, a bottom edge, a left side, and a right side, the right side having a curved edge, the red square flag having a first position being displayed in the window indicating the presence of mail and a second position not being displayed in the window indicating the absence of mail.

4. The device as described in claim 3 and further comprising:

a spring secured to the curved edge of the red square flag, the spring having a top section, a bottom section, and an intermediate extent therebetween, an aperture formed through the intermediate extent of the spring, the spring functioning to urge the red square flag to the first position indicating the presence of mail.

5. The device as described in claim 1 and further including:

a horizontal slot formed through the newspaper housing lid, the horizontal slot having a first end and a second end, the first end having a downward extension.

6. The device as described in claim 5 and further including:

a knob dimensioned to be received within the horizontal slot, the knob positioned in the second end of the horizontal slot corresponding to the red square flag in the first position, the knob in the first end of the horizontal slot corresponding to the red square flag in the second position.

7. The device as described in claim 6 and further including:

a pulley system including a cable, the cable having a first end, a second end, and an intermediate extent therebetween, the first end being secured to the knob, the second end being secured to the flat surface of the red square flag, the intermediate extent being received through the aperture formed within the intermediate extent of the spring, the pulley system functioning to retract the red square flag away from the window to the second position indicating the absence of mail.

* * * * *